US010068441B2

(12) United States Patent
Henrie

(10) Patent No.: US 10,068,441 B2
(45) Date of Patent: Sep. 4, 2018

(54) SECURITY SYSTEM PROVIDING A LOCALIZED HUMANLY-PERCEIVABLE ALERT FOR IDENTIFYING A FACILITY TO EMERGENCY PERSONNEL

(71) Applicant: Vivint, Inc., Provo, UT (US)

(72) Inventor: James B. Henrie, Lehi, UT (US)

(73) Assignee: Vivint, Inc., Provo, UT (US)

( * ) Notice: Subject to any disclaimer, the term of this patent is extended or adjusted under 35 U.S.C. 154(b) by 0 days.

(21) Appl. No.: 15/728,292

(22) Filed: Oct. 9, 2017

(65) Prior Publication Data

US 2018/0096571 A1 Apr. 5, 2018

Related U.S. Application Data

(63) Continuation of application No. 15/133,518, filed on Apr. 20, 2016, now Pat. No. 9,786,137, which is a continuation of application No. 14/211,275, filed on Mar. 14, 2014, now Pat. No. 9,349,262.

(60) Provisional application No. 61/786,341, filed on Mar. 15, 2013.

(51) Int. Cl.

| | |
|---|---|
| ***G08B 3/00*** | (2006.01) |
| ***G08B 7/06*** | (2006.01) |
| ***G08B 5/38*** | (2006.01) |
| ***G08B 13/04*** | (2006.01) |

(52) U.S. Cl.

CPC ..... *G08B 7/064* (2013.01); *G08B 5/38* (2013.01); *G08B 13/04* (2013.01)

(58) Field of Classification Search

CPC ..... G08B 5/38
USPC ..... 340/540–542, 691.1
See application file for complete search history.

(56) References Cited

U.S. PATENT DOCUMENTS

| | | | | |
|---|---|---|---|---|
| 4,212,003 A | | 7/1980 | Mishoe et al. | |
| 4,730,184 A | | 3/1988 | Bach | |
| 5,012,507 A | * | 4/1991 | Leighton | H04M 11/04 379/37 |
| 5,636,263 A | | 6/1997 | Thomson | |

(Continued)

FOREIGN PATENT DOCUMENTS

JP 10222774 A 8/1998

OTHER PUBLICATIONS

English translation of JP10-222774 dated Aug. 21, 1998.
International Search Report for PCT/US2014/028455, dated Jul. 14, 2014.

*Primary Examiner* — Eric M Blount
(74) *Attorney, Agent, or Firm* — Holland & Hart LLP

(57) ABSTRACT

The present disclosure relates to systems and methods for guiding emergency personnel to a location in a facility proximate to an alarm that has been generated. In one aspect, a method may include detecting an alarm condition at a facility protected by a security system and determining a location at the facility of the alarm condition. The method may further include causing at least one indicator at the facility, which is proximate to the determined location of the alarm condition, to generate an identifying alert that is humanly perceivable from an exterior of the facility such that emergency personnel can identify the facility based at least in part on the identifying alert. In some aspects, the method may also include notifying a security representative of the alarm condition, and receiving a notification from the security representative indicating that emergency personnel are dispatched to the facility.

20 Claims, 9 Drawing Sheets

(56) References Cited

U.S. PATENT DOCUMENTS

| | | | | |
|---|---|---|---|---|
| 5,781,108 | A | 7/1998 | Jacob et al. | |
| 5,790,019 | A | 8/1998 | Edwin | |
| 5,889,468 | A | 3/1999 | Banga | |
| 5,991,363 | A | 11/1999 | Thomson | |
| 6,009,148 | A | 12/1999 | Reeves | |
| 6,205,203 | B1 | 3/2001 | Gorman et al. | |
| 6,307,920 | B1 | 10/2001 | Thomson et al. | |
| 6,400,265 | B1 * | 6/2002 | Saylor | G08B 13/19602 340/506 |
| 6,956,478 | B2 | 10/2005 | Oyagi et al. | |
| 7,068,760 | B2 * | 6/2006 | Binning | H04M 11/04 379/45 |
| 7,355,507 | B2 * | 4/2008 | Binning | G08B 7/064 340/332 |
| 7,529,351 | B2 * | 5/2009 | Binning | H04L 12/66 379/45 |
| 7,822,391 | B1 | 10/2010 | Delker et al. | |
| 8,599,018 | B2 * | 12/2013 | Kellen | G08B 5/36 340/541 |
| 8,624,735 | B2 * | 1/2014 | Kellen | G08B 5/36 340/541 |
| 8,666,104 | B2 | 3/2014 | Ivey et al. | |
| 8,823,793 | B2 | 9/2014 | Clayton et al. | |
| 2004/0036603 | A1 | 2/2004 | Bingham | |
| 2004/0201565 | A1 | 10/2004 | Cunningham et al. | |
| 2006/0038691 | A1 | 2/2006 | Bard | |
| 2006/0197661 | A1 | 9/2006 | Tracy et al. | |
| 2007/0194906 | A1 | 8/2007 | Sink | |
| 2012/0086572 | A1 | 4/2012 | Tsai | |
| 2012/0126978 | A1 | 5/2012 | Kellen et al. | |
| 2014/0062714 | A1 * | 3/2014 | Chvatal | G08B 5/38 340/815.73 |

* cited by examiner

SECURITY SYSTEM PROVIDING A LOCALIZED HUMANLY-PERCEIVABLE ALERT FOR IDENTIFYING A FACILITY TO EMERGENCY PERSONNEL

CROSS REFERENCE TO RELATED APPLICATION

This application is a continuation of U.S. patent application Ser. No. 15/133,518 entitled "Security System Providing A Localized Humanly-Perceivable Alert For Identifying A Facility To Emergency Personnel," filed on Apr. 20, 2016, which is a continuation of U.S. patent application Ser. No. 14/211,275 entitled "Security System Providing A Localized Humanly-Perceivable Alert For Identifying A Facility To Emergency Personnel," filed Mar. 14, 2014, which claims the benefit of U.S. Provisional Patent Application No. 61/786,341 entitled "Security System Providing A Humanly-Perceivable Alert For Identifying A Facility To Emergency Personnel," filed on Mar. 15, 2013, which is assigned to the assignee hereof.

TECHNICAL FIELD

This disclosure relates generally to security systems and, more specifically, to security systems that use indicators perceivable from the exterior of the facility that help responders identify the affected facility.

BACKGROUND OF RELATED ART

Security systems are widely used to protect property and provide personal safety. Security systems generally include a control unit that controls the overall operation of the system, one or more keypads providing user access to the system, and various detectors and sensors.

Security systems may generate an alarm in response to any number of events, such unauthorized entry, fire, medical emergency, or manual alarm activation. The security system may be associated with a service that remotely monitors the status of the security system. Thus, if the security system generates an alarm, a notification signal (also referred to herein as an alarm communication) may be transmitted via a wired and/or wireless communications link to a central station. Upon receiving the alarm communication, security service personnel at the central station may attempt to contact the property owner or other party at the facility to verify the alarm. If it is appropriate to do so, the security service representative may, upon confirmation of the alarm, contact an emergency response agency such as the police department, the fire department, an emergency medical team, or other appropriate entity.

One challenge facing emergency personnel responding to the alarm is locating the facility that generated the alarm. While emergency personnel usually have an address for the facility, locating the facility still takes time. If it is dark out, it can be difficult to see house numbers. Even during daylight hours, finding the exact facility on a particular street can take a few minutes. Where the facility is an apartment, identifying which of many apartments generated the alarm can be difficult. In many emergency situations, even seconds count, such that the time lost while emergency personnel are trying to find the facility may be critical.

BRIEF SUMMARY OF THE DISCLOSURE

Disclosed herein are methods, systems, devices, and approaches to indicating to emergency personnel which facility has generated the alarm they are responding to. In one embodiment, a security system includes one or more sensors that generate an alarm condition message in response to an alarm condition. The system may also include a control unit that is communicatively coupled to the sensor and that receives the alarm condition message from the sensor and that sends an identification message to a controller for an indicator. The controller receives the identification message from the control unit and causes the indicator to generate an identifying alert in response. The identifying alert generated by the indicator may be humanly perceivable from the exterior of the facility protected by the security system. The identifying alert may be a visual alert (such as flashing lights), an audible alert, or combination thereof. The indicator may be an existing element within the facility (such as an exterior light) or may be a dedicated component provided to generate the identifying alert.

In certain embodiments, the indicator may also localize the identifying alert to a location of the facility where the alarm condition occurred. For example, if a smoke detector detects smoke, the selected indicator may be the interior light in the room containing the smoke detector. The indicator may be one or more existing elements (such as the lights) within the facility which are connected to controllers to provide the functionality described herein. The controller may be a component in a building automation system for the facility that provides control of the lights in the facility.

Also disclosed herein is a non-transitory computer-readable storage medium that stores instructions that are executable by a processor. The storage medium may include instructions for receiving an identification message that indicates the occurrence of an alarm condition and the dispatch of emergency personnel to the facility protected by the security system. The storage medium may also include instructions for causing the identifying alert that identifies the facility associated with the security system and for which the identification message was generated. The identifying alert may identify a particular area, e.g. a room, of the facility where the alarm condition originated. In one embodiment, the storage medium and the instructions thereon are part of a control unit installed in the facility.

Further disclosed herein is a method that involves detecting an alarm condition at a facility and notifying a security representative of the alarm condition. The method may also involve receiving a notification from the security representative that indicates that emergency personnel are dispatched to the facility, and sending an identification message to the controller for the indicator. The identification message may cause the indicator to generate an identifying alert that is humanly perceivable from the exterior of the facility that is protected by the security system such that the emergency personnel can identify the facility based at least in part on the identifying alert. The indicator may be selected to localize the identifying alert to an area, e.g. a room, of the facility where the alarm condition originated.

Other aspects, as well as features and advantages of various aspects, of the present disclosure will become apparent to those of skill in the art though consideration of the ensuing description, the accompanying drawings, and the appended claims.

DETAILED DESCRIPTION

Referring in general to the accompanying drawings, various embodiments of the present disclosure are illustrated to show the structure and methods for installing a component within a system, such as a security system. Common elements of the illustrated embodiments are designated with like numerals. It should be understood that the figures presented are not meant to be illustrative of actual views of any particular portion of the actual device structure, but are merely schematic representations which are employed to more clearly and fully depict embodiments of the disclosure.

The following provides a more detailed description of ways to implement the present disclosure and various representative embodiments thereof. In this description, functions may be shown in block diagram form in order not to obscure the present disclosure in unnecessary detail. Additionally, block definitions and partitioning of logic between various blocks is exemplary of a specific implementation. It will be readily apparent to one of ordinary skill in the art that the present disclosure may be practiced by numerous other solutions. For the most part, details concerning timing considerations and the like have been omitted where such details are not necessary to obtain a complete understanding of the present disclosure and are within the abilities of persons of ordinary skill in the relevant art.

In this description, some drawings may illustrate signals as a single signal for clarity of presentation and description. It will be understood by a person of ordinary skill in the art that the signal may represent a bus of signals, wherein the bus may have a variety of bit widths and the present disclosure may be implemented using any number of data signals including a single data signal.

Figure 1:
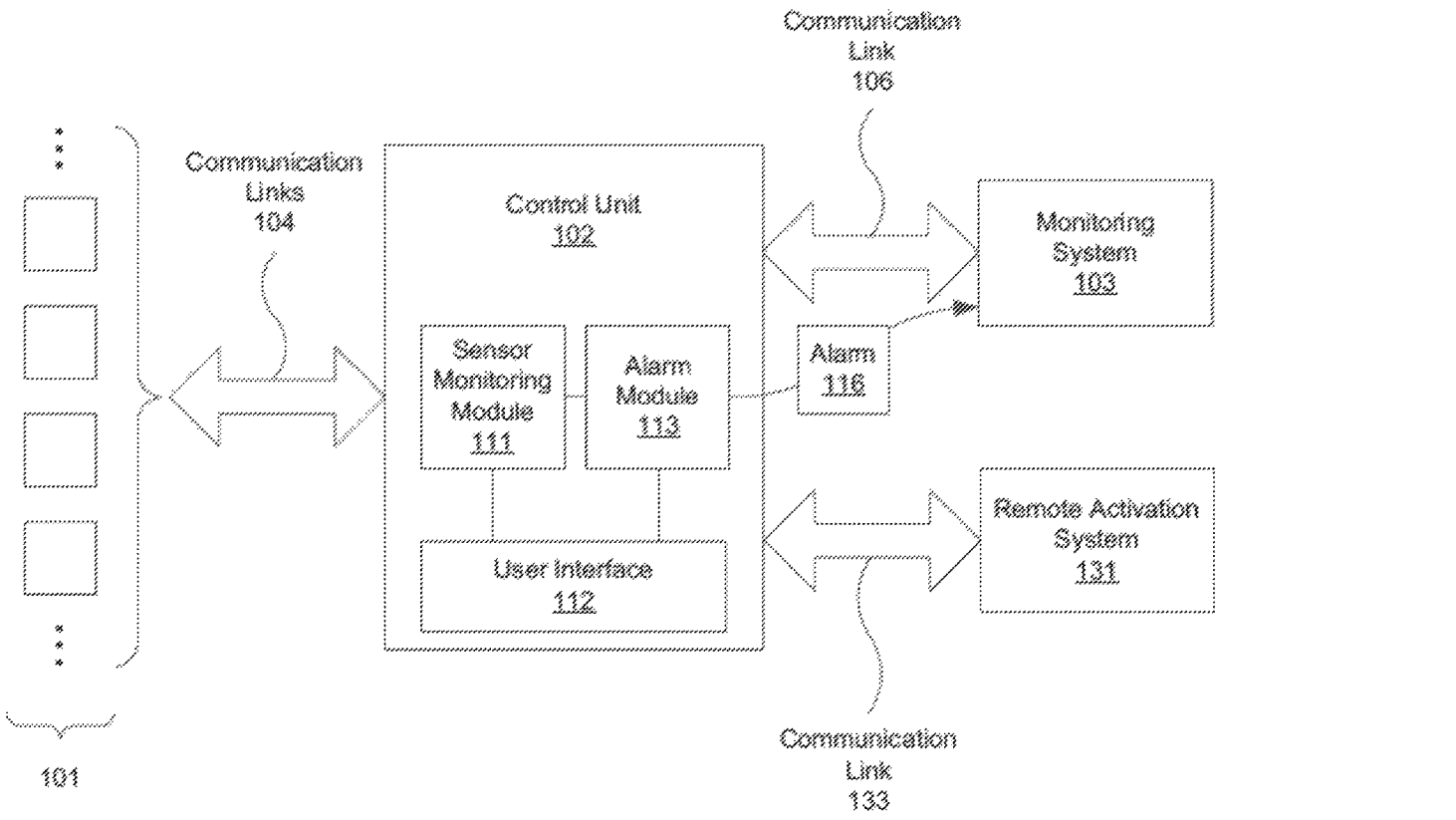
FIG. 1 illustrates an embodiment of a security system.

FIG. 1 illustrates an embodiment of a security system 100, which may also be referred to as an "alarm system." The security system 100 includes sensors 101, a control unit 102, monitoring system 103, and remote activation system 131. Communication links 104 (which may be a combination of wired and wireless communication links) couple sensors 101 to control unit 102. Wired communication links can include circuit loops that are either detected as closed or open. In some embodiments, sensors 101 and control unit 102 are located in the same facility, such as in the same residence or in the same building. Communication link 106 (which may be a wired telephone connection, wired or wireless network connection, cellular connection, etc., or combination thereof) may couple the control unit 102 to monitoring system 103. In other embodiments, the system shown in FIG. 1 may be implemented without a monitoring system 103.

Sensors 101 monitor for certain events and report relevant events to the control unit 102. Sensors 101 may include any of a variety of different types of sensors, such as door and window sensors, motion sensors, glass break sensors (e.g., sensors that detect a physical break or detecting the sound of a glass break), etc. The control unit 102 may be configured to monitor sensors 101 for alarm conditions via communication links 104 and to relay alarms to the monitoring system 103 via communication link 106. The sensors 101 may, in response to detecting an alarm condition, send an alarm condition message to the control unit 102 as described in further detail below.

Control unit 102 may include sensor monitoring module 111, user interface 112, and alarm module 113. Sensor monitoring module 111 may be configured to monitor sensors 101. Sensors 101 can sense and/or indicate a change in their physical surroundings (e.g., a normally closed connection becomes open, a signal indicating that the sound of breaking glass was detected, detection of smoke, etc.) which may be indicative of an unauthorized access, fire, or other emergency. The sensors 101 may communicate messages on communication links 104. For example, a circuit connected to a door sensor can transition from closed to open (or to a resistance exceeding a pre-determined resistance threshold) indicating that a door has been opened. A motion sensor 101 can send an electrical signal indicative of detected motion. Sensor monitoring module 111 may monitor communication links 104 for alarm condition messages sent from sensors 101. Upon sensor monitoring module 111 receiving an alarm condition message signaling occurrence of an alarm condition, sensor monitoring module 111 may send a signal to alarm module 113. The alarm module 113 may determine whether an alarm condition has actually occurred before communicating with the monitoring system 103.

User interface 112 can include an input interface and an output interface. The input interface can comprise a physical input interface or virtual input interface that may include a numeric key pad (e.g., for entering a disarm code, etc.), sensor activation buttons, physical duress buttons, or other input/output devices. The input interface can include a condenser for receiving audio input and/or communicating with monitoring system 103. The output interface may include an output display device that displays system status, such as armed and disarmed, sensors/zones that have detected change in physical surroundings, and other relevant information. The output interface can also include a speaker that audibly outputs information similar to that displayed on the output display device. The speaker can also be used by monitoring system 103 to communicate with a user of control unit 102.

The control unit 102 may also communicate over a communication link 133 with a remote activation system 131. The remote activation system 131 may allow a user to interact with the control unit 102 remotely. For example, the user may be able to arm and disarm the system 100 from a mobile device such as a cellular phone using the remote activation system 131.

Figure 2:
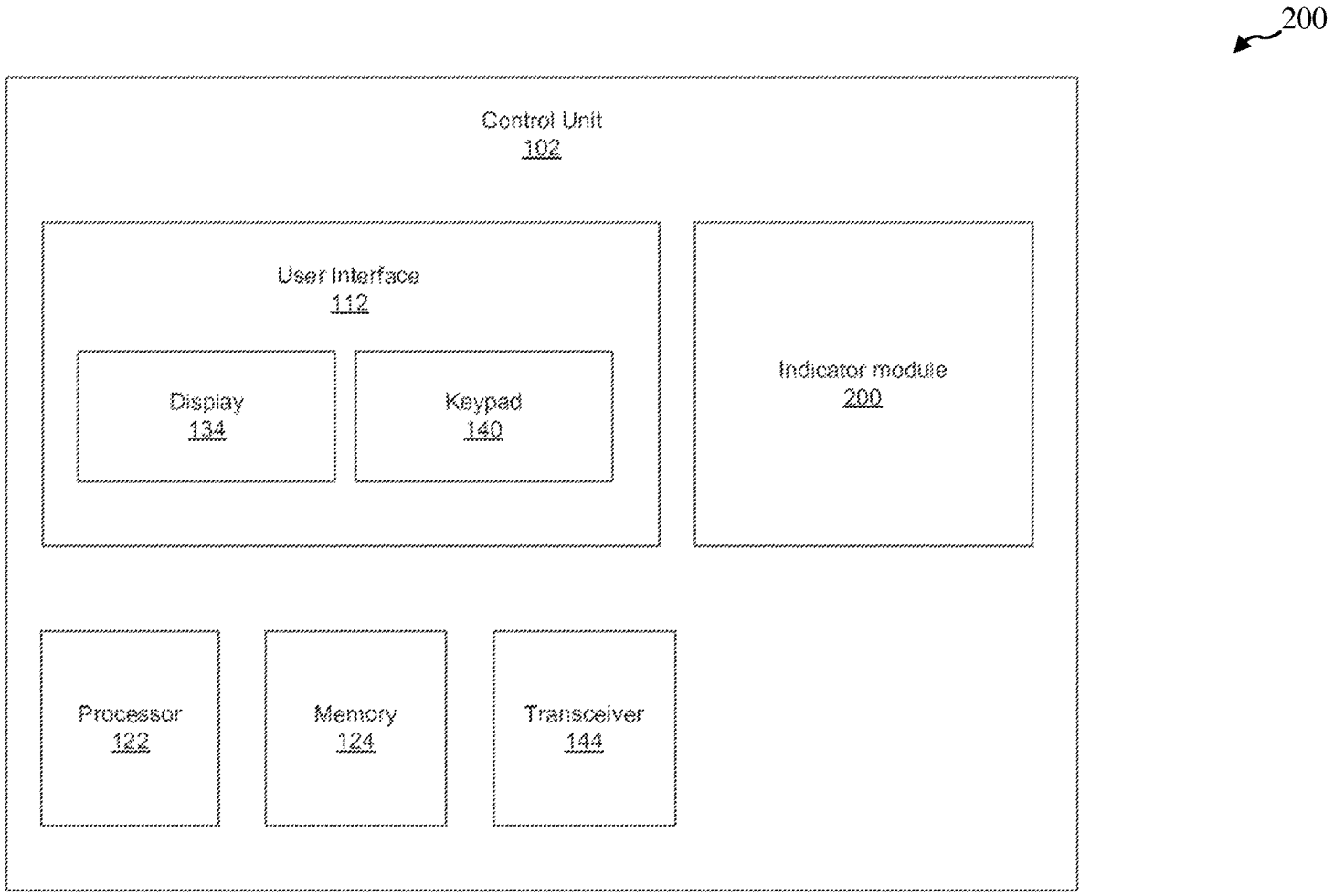
FIG. 2 is a block diagram of an embodiment of a control unit of a security system.

FIG. 2 is a block diagram of one embodiment of a control unit 102. Control unit 102 may include a processor 122, memory 124, transceiver 144, and user interface 112. User interface 112 may include various input/output (I/O) devices, such as a display 134, which may comprise a touch screen, and keypad 140. Control unit 102 may further include a transceiver 144 for receiving and transmitting data over a network. It is noted that a "communication interface" as referred to herein may include transceiver 144 and user interface 112. The control unit 102 may be capable of communicating over more than one network; for example, the control unit 102 may be capable of communicating with a radio frequency identification (RFID) tag, a wireless Internet network, a cellular network, and others.

Generally, control unit 102 may operate under control of an operating system stored in memory 124, and interface with a user to accept inputs and commands and to present outputs through user interface 112. Control unit 102 may also implement a compiler (not shown) which allows one or more application programs (not shown) written in a programming language to be translated into processor 122 readable code. Instructions implementing an application program may be tangibly embodied in a computer-readable medium. Further, an application program may include instructions which, when read and executed by processor 122, cause processor 122 to perform the steps necessary to implement and/or use embodiments of the present disclosure. It is noted that an application program and/or operating instructions may also be tangibly embodied in memory 124 and/or data communications devices, thereby making a computer program product or article of manufacture according to an embodiment the present disclosure. As such, the term "application program" as used herein is intended to encompass a computer program accessible from any computer readable device or media. Furthermore, portions of the application program may be distributed such that some of the application program may be included on a computer readable media within control unit 102, and some of the application program may be included in a remote device, such as a remote computer.

The control unit 102 may further include an indicator module 200. The indicator module 200 may be software, firmware, hardware, or a combination thereof. While FIG. 2 illustrates the indicator module 200 as a component of the control unit 102, the indicator module 200 may, in other embodiments, be implemented separate from the control unit 102. In certain embodiments, the indicator module 200 is distributed across various components within a facility. The indicator module 200 may cause an indicator to generate an identifying alert that can be perceived from outside the facility implementing the system 100 such that emergency personnel dispatched to the facility can quickly and easily identify the relevant facility. For example, the indicator module 200 may cause an exterior light of a house to flash on and off to so that emergency personnel can quickly identify the house.

In some embodiments, the control unit 102 may receive one or more alarm condition messages from one or more sensors 101. For example, a sensor monitoring module 111 of the control unit 102 (see FIG. 1) may regularly or periodically monitor communication links 104 and detect an alarm condition message from one or more sensors 101, such as an open door, a smoke alarm detecting smoke in a room, a breaking window, etc. The alarm condition message may indicate an ID of the sensor(s) 101 from which the alarm condition message originated. The indicator module 200, the processor 122, and/or memory 124 may, based on the ID of sensor(s) 101 from which the alarm condition message originated, determine a location or a proximate location of the alarm condition. The indicator module 200 may then instruct one or more indicators in close proximity to the location of the alarm condition (e.g. near the sensor(s) 101 from which the alarm condition message originated) to generate an identifying alert, such as one or more lights of the facility to flash on and off. Generating the identifying alert may include causing interior lights that may be perceived from outside the facility implementing the system 100 to flash, outdoor lights that may be close to the location where the alarm condition occurred to flash, etc.

Figure 3:
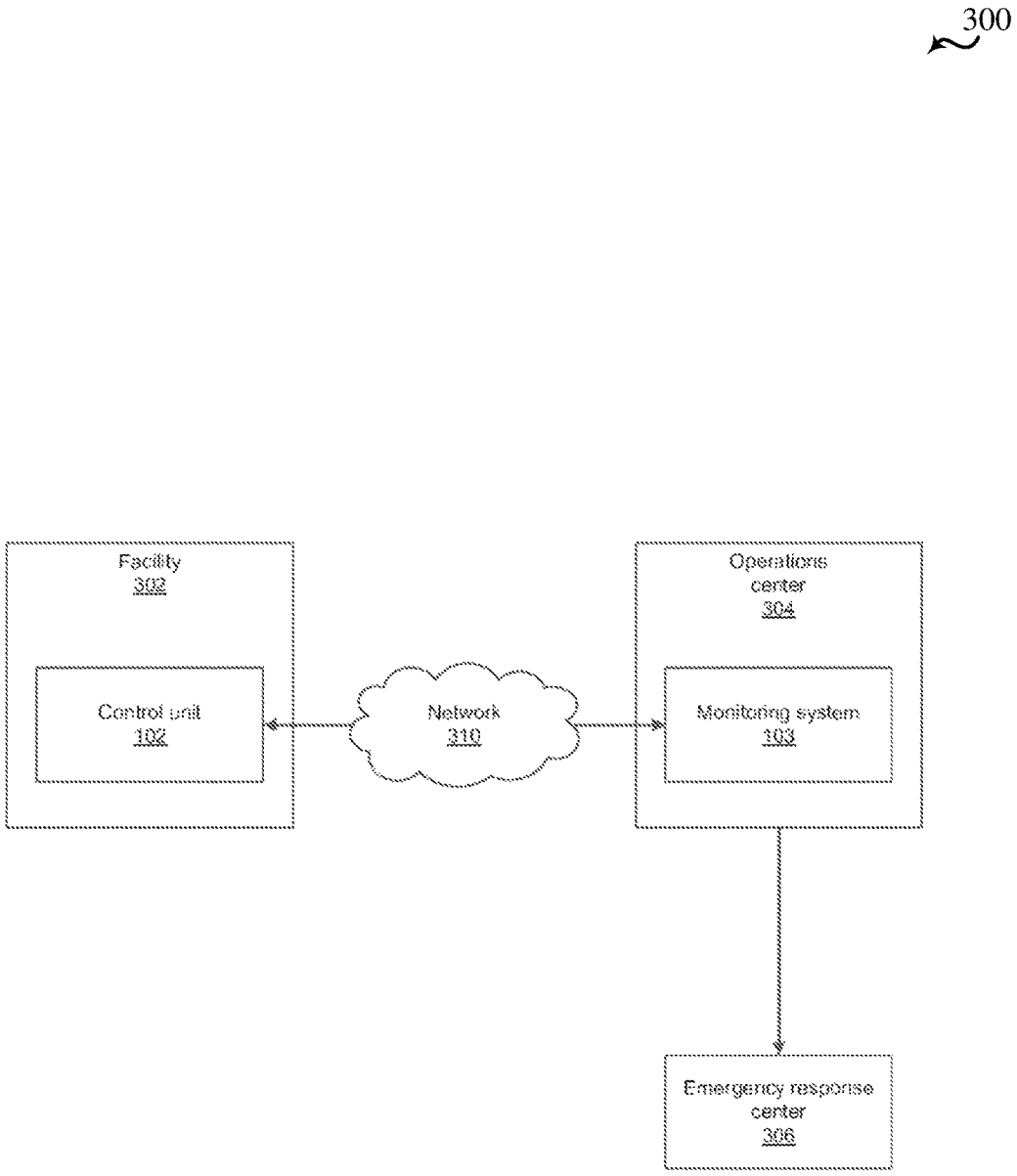
FIG. 3 is a schematic block diagram illustrating one embodiment of a system including a facility, an operations center, and an emergency response facility.

FIG. 3 illustrates one embodiment of a system 300 including a facility 302, an operations center 304, and an emergency response center 306. A facility 302, as used herein, refers to a physical location and typically includes one or more structures. The facility 302 may be a residence, a place of business, a government facility, a construction site, or other type of facility. The facility 302 includes a control unit 102 and implements a security system, such as security system 100 as described in reference to FIG. 1.

The system 300 also includes an operations center 304 implementing a monitoring system 103. The monitoring system 103 may, in certain embodiments, be implemented without an associated operations center 304. The operations center 304 provides systems and personnel that support the security functions of the security system implemented at the facility 302. For example, the control unit 102 may communicate with a monitoring system 103 in the event of an alarm condition at the facility 302. A security representative situated at the operations center 304 may review the alarm condition notifications communicated to the monitoring system 103. The security representative may attempt to contact an individual associated with the facility 302 by phone, through the control unit 102, or by other means. In appropriate circumstances, the security representative and/or the individual associated with the facility 302 may contact an emergency response center 306 and dispatch emergency response personnel to the facility 302.

For example, the control unit 102 may send the monitoring system 103 an alarm condition notification indicating that a fire alarm at the facility 302 has been triggered. The security representative at the operations center 304 may review the alarm condition notification sent to the monitoring system 103 and attempt to contact a person at the facility 302 via the control unit 102. After confirming that there is a fire at the facility 302, the security representative may call 9-1-1 and ask that firefighters be dispatched to the facility 302.

The facility 302 may include one or more indicators as discussed in more detail below. For example, the facility 302 may have an exterior light that is in communication with the control unit 102, the monitoring system 103, or both. After the firefighters are dispatched to the facility 302, the security representative may cause the exterior light to flash on and off, making it easier for the firefighters to determine which facility 302 has the fire they are responding to. Based on the alarm condition notification, the security representative may also cause one or more lights of facility 302, which may include interior and/or exterior lights, near the location of the alarm condition (e.g. in close proximity to the sensor(s) 101 from which the alarm condition message originated) to flash on and off, for example, to further help the dispatched firefighters to quickly locate the particular location or area, room, etc., within facility 302 of the alarm condition.

The system 300 also includes a network 310. The network 310 communicatively couples the control unit 102 of the facility 302 with one or more separate devices, such as the monitoring system 103. The network 310 may be an Internet network, a telephone network, a cellular network, or other variety of communications network. In certain embodiments, the control unit 102 may be configured to connect with more than one network 310; such an embodiment may provide redundancy and make the system 300 more robust.

Figure 4:
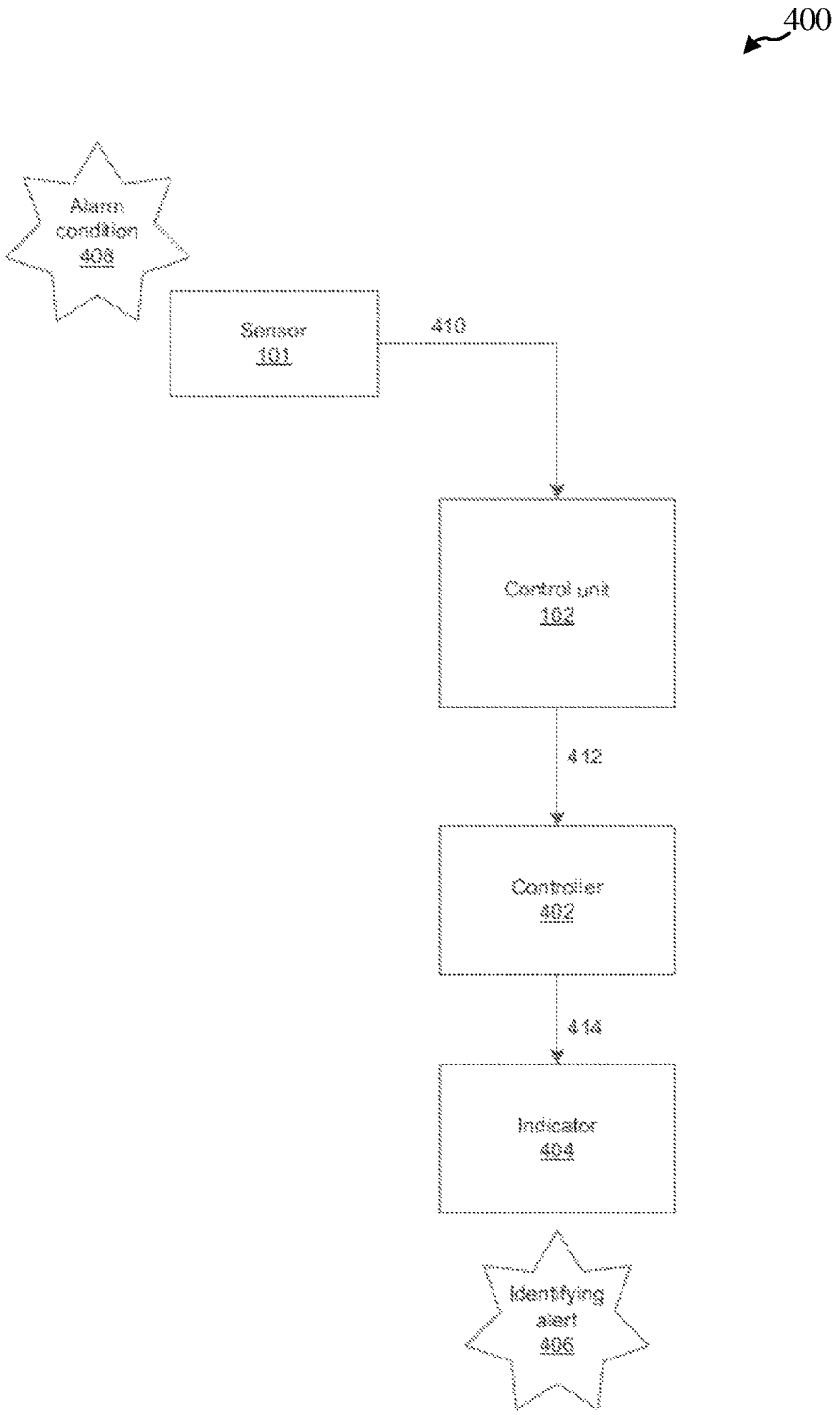
FIG. 4 is a schematic block diagram illustrating one embodiment of a security system providing an identifying alert in response to an alarm condition.

FIG. 4 illustrates a security system 400 that may be implemented at a facility 302. The security system 400 includes at least one sensor 101, control unit 102, controller 402, and indicator 404. The term "security system" is used broadly to encompass a wide range of security-related installations using sensors 101 to detect potential threats. The security system 400 may be designed specifically for fire, burglary, and other security threats, or combinations thereof.

The sensor 101 may detect an alarm condition 408, as described above. For example, the sensor 101 may be a fire alarm that detects the presence of smoke in the facility 302. The sensor 101 may be configured to generate an alarm condition message 410 in response to the alarm condition 408. The alarm condition message 410 communicates that an alarm condition has been detected, and may include an ID of the sensor 101, a location of the sensor 101, or other identification information. The sensor 101 may push the alarm condition message 410 to the control unit 102, or the control unit 102 may poll for the alarm condition message from the sensor 101. The alarm condition message 410 may be sent over a wireless or wired connection to the control unit 102.

The control unit 102 may be communicatively coupled to the sensor 101 and may receive the alarm condition message 410 from the sensor 101. The control unit 102 may be configured to determine whether the alarm condition message 410 was generated in response to a valid alarm condition 408. For example, if the sensor 101 detects that the front door is opened and the security system 400 is not armed, the control unit 102 may decide that the alarm condition 408 is invalid and not act on the alarm condition message 410. However, if the security system 400 is armed, the control unit 102 may determine that the alarm condition 408 is valid and interpret the alarm condition message 410 to be evidence of an unauthorized entry. The control unit 102 may then act upon the alarm condition message 410.

The control unit 102 may be further configured to send an identification message 412 to the controller 402 associated with one or more indicators 404 if the alarm condition 408 is valid. The identification message 412 may instruct the controller 402 to generate an identifying alert 406 using the indicator 404. The identifying alert 406 may identify the location of the facility 302, and may be localized to an area from which the alarm condition 408 occurred. The control unit 102 may send the identification message 412 in response to the alarm condition message 410 after determining that the alarm condition message 410 is in response to a valid alarm condition 408. The control unit 102 may, in certain embodiments, send the identification message 412 in response to a valid alarm condition message 410 in combination with a dispatch notification (discussed further below) indicating that emergency personnel have been dispatched to the facility 302.

The controller 402 may be an electronic device communicatively coupled to the control unit 102 and the indicator 404 and may be configured to respond to an identification message 412. The controller 402 may be a programmable logic controller (PLC), a system/network controller, a terminal unit controller, or other variety of controller 402. The controller 402 may implement firmware or software allowing it to receive the identification message 412 from the control unit 102 and to control the indicator 404 and thus generate the identifying alert 406. The controller 402 may cause the indicator 404 to generate an identifying alert 406 in response to receiving the identification message 412. The controller 402 may send one or more control messages 414 to the indicator 404. In one embodiment, the controller 402 sends one or more control messages 414 that alternate between providing power and cutting power to an indicator 404 that is a light fixture.

The indicator 404 and the controller 402 may form an integral unit. In other embodiments, the indicator 404 and the controller 402 may be implemented separately and connected by a communications connection allowing the controller 402 to send control messages 414 to the indicator 404. The indicator 404 may be a physical device capable of generating a humanly perceivable identifying alert. The identifying alert may also be perceivable by a human from an exterior of the facility that is protected by the security system 400. In one embodiment, the identifying alert is a visual alert that is visible from the exterior of the facility. The indicator 404 may, for example, be a light at the facility protected by the security system 400. The light may be an interior light that is visible from the street through a window. The light may be an exterior light, such as a porch light or street lamp, that is visible from the street.

The indicator 404 may be a light that is provided as part of the security system. In one embodiment, the indicator 404 may be a strobe light. The owner of the facility 302 may be instructed to place the indicator 404 in a location visible from the street. For example, the indicator 404 may be placed outside the facility 302 or in a window visible from the street in front of the facility 302. In an embodiment where the indicator 404 is a strobe light, the controller 402 may send a control message 414 to turn the strobe light on in response to receiving an identification message 412.

In other embodiments, the indicator 404 may provide an identifying alert 406 that is audible. The indicator 404 may generate an audible alarm that can be used to help determine the location of the facility 302 and/or an area of facility 302 from which the alarm condition 408 originated. The indicator 404 may use both audible and visible components to an identifying alert 406.

In certain embodiments, the control unit 102 and/or the controller 402 may vary the nature of the identifying alert 406 according to the nature of the alarm condition 408. For example, knowing the location where the alarm condition 408 originated may be helpful for certain alarm conditions 408. The control unit 102 may use an exterior light as an indicator 404 in response to an alarm condition 408 associated with an unauthorized entry. Since knowledge of the location where a person gained unauthorized access may not be critical to emergency personnel, the use of the exterior light alone may be sufficient. The control unit 102 may use an exterior light and an interior light in the same room as a smoke detector in response to an alarm condition 408 associated with a fire. The use of the interior light may help firefighters locate the exact position of the fire in the facility 302 and allow them to more quickly and appropriately respond.

The control unit 102 and/or the controller 402 may vary the nature of the identifying alert 406 according to other conditions as well. For example, the time of day may affect the type of identifying alert 406. If the identifying alert 406 is generated after dark, the control unit 102 may cause the controller 402 to generate an identifying alert 406 that is only visual, such as a flashing light. If the identifying alert 406 is generated during daylight hours, the control unit 102 may cause the controller 402 to provide an identifying alert 406 that is both visual and audible.

Figure 5:
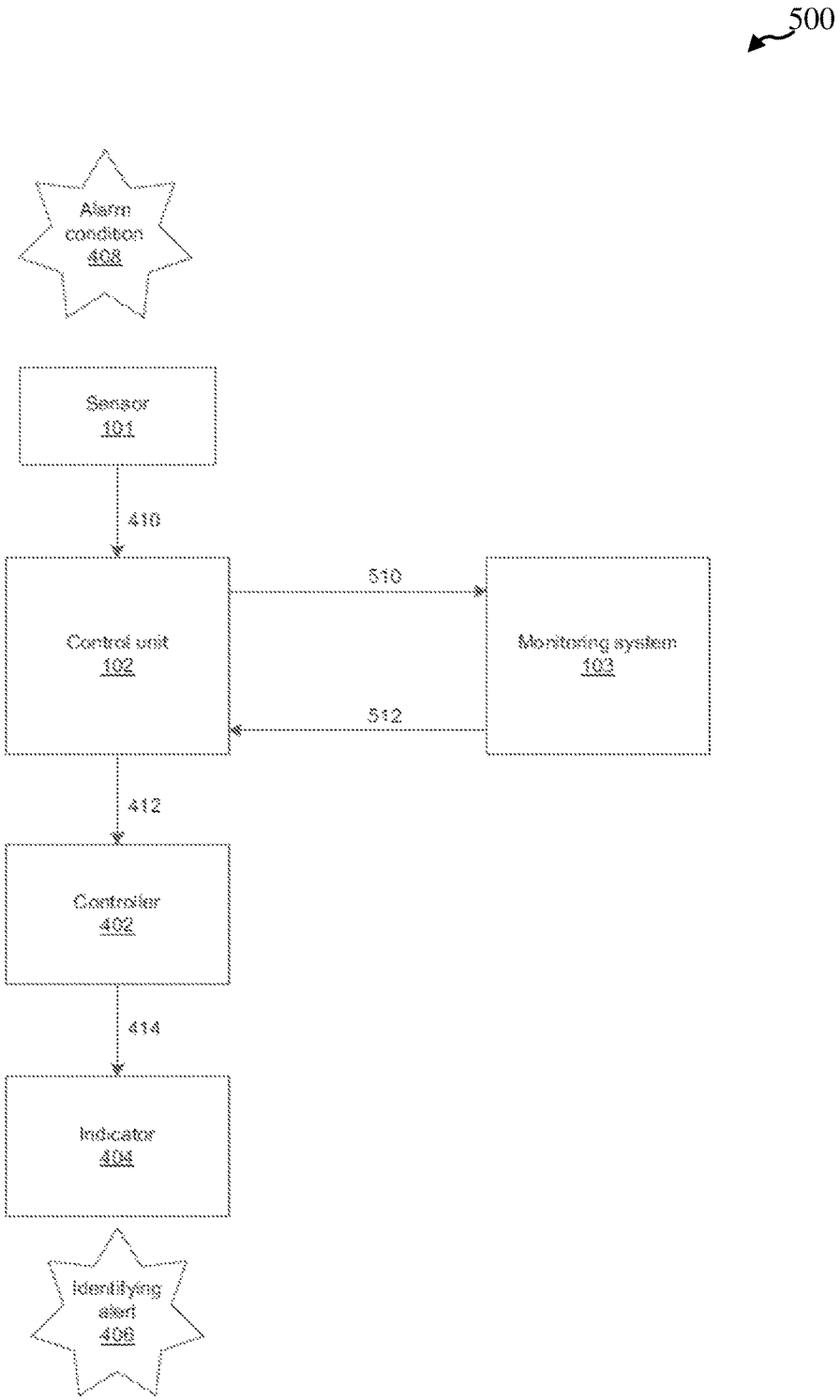
FIG. 5 is a schematic block diagram illustrating another embodiment of a security system providing an identifying alert in response to an alarm condition.

FIG. 5 shows a system 500 that includes a monitoring system 103 as described above. In the system 500, the control unit 102, after receiving the alarm condition message 410, sends an alarm communication 510 to the monitoring system 103. The monitoring system 103 may review the alarm condition message 410 to determine whether an alarm condition 408 has occurred that requires the assistance of emergency personnel. An individual employed by a security company may review the alarm communication 510 to ensure that it is valid before dispatching emergency personnel to the facility 302.

If the security representative determines that the alarm communication 510 was generated in response to an authentic emergency, the security representative and/or the individual associated with facility 302 may dispatch emergency personnel to the facility 302 implementing the system 500. The monitoring system 103 may send a dispatch notification 512 to the control unit 102 indicating that emergency personnel have been dispatched. In other embodiments, the monitoring system 103 may send the dispatch notification 512 to the controller 402. The control unit 102 may, in certain embodiments, poll the monitoring system 103 for dispatch notifications 512.

The control unit 102 may be configured to send the identification message 412 to the controller 402 in response to receiving both the alarm condition message 410 and the dispatch notification 512. Such an embodiment may ensure that the identifying alert 406, which is intended to guide emergency personnel, is generated only when necessary.

Figure 6:
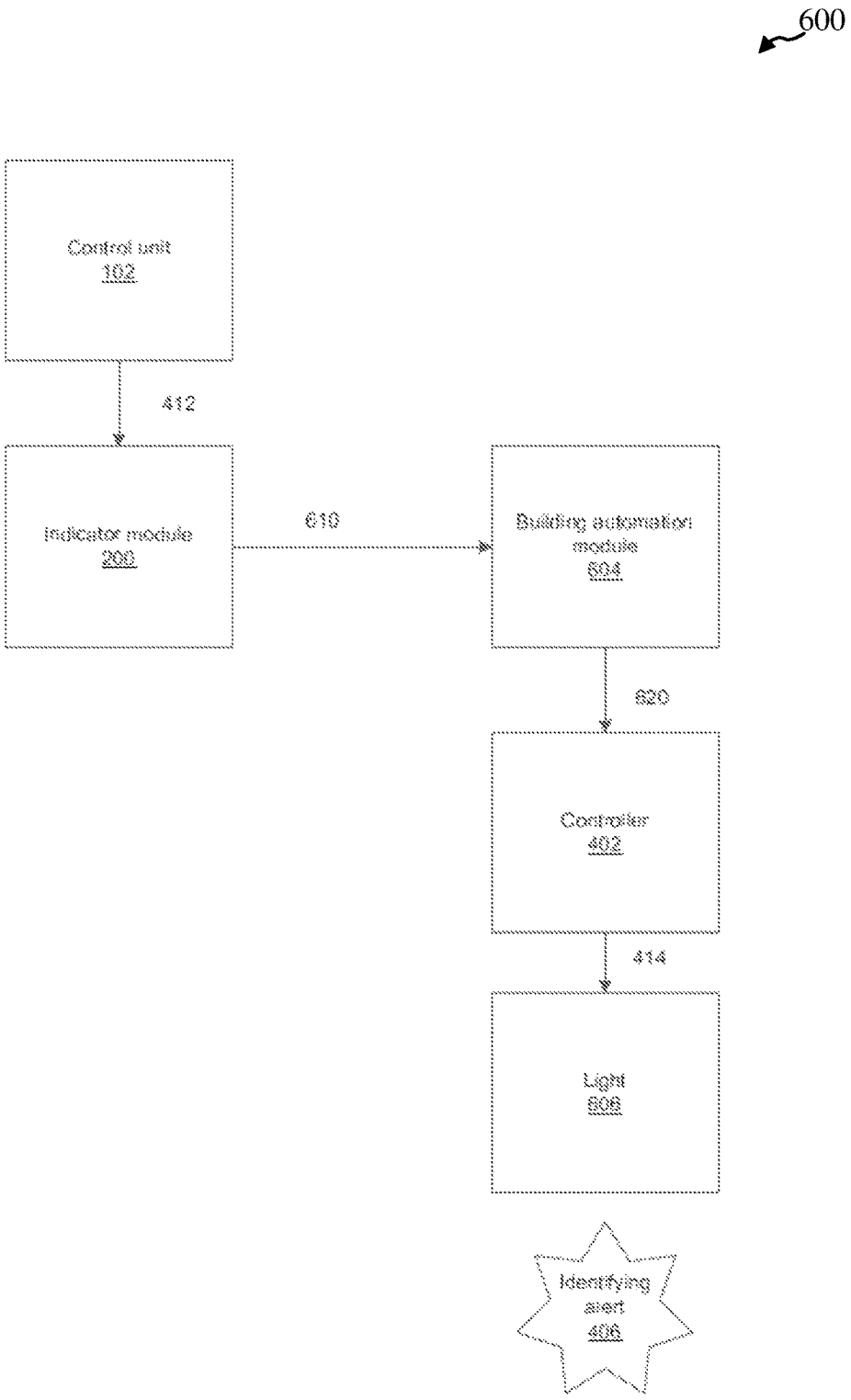
FIG. 6 is a schematic block diagram illustrating an indicator module interacting with a building automation module.

FIG. 6 shows an embodiment of a system 600 having a control unit 102 that communicates with a building automation module 604. In the depicted illustration, the system 600 includes a control unit 102, an indicator module 200, a building automation module 604, a controller 402, and a light 606. The system 600 may be configured to use the light 606 as the indicator. The light 606 may be a standard lighting solution that provides light in the facility 302 implementing the system 600. For example, the light 606 may include a porch light, a lamp, a can light, or other variety of light fixture.

The indicator module 200 may communicate with the control unit 102 and the controller 402 through the building automation module 604, to provide an identifying alert 406 using the light 606. While FIG. 6 illustrates the indicator module 200 and the building automation module 604 as separate from the control unit 102, in other embodiments, the indicator module 200 and the building automation module 604 are implemented in the control unit 102. The indicator module 200, in certain embodiments, may be distributed throughout physical components in the system 600. The indicator module 200 may be implemented as instructions stored on a non-transitory computer-readable storage medium such as a hard disk drive (HDD), a random access memory (RAM), a solid state storage device (SSD), or other variety of non-transitory computer-readable storage medium.

While FIG. 6 shows a single light 606, the indicator module 200 may be able to control multiple lights within the facility 302. For example, a typical building automation module 604 can control a large number of lights within the facility 302. The indicator module 200 may be configured to use some or all of the lights controllable through the building automation module 604. The indicator module 200 may have granular control such that it can control on and off particular lights, and groups of lights, of the lights that are installed in the system 600 and controllable using the building automation module 604.

The building automation module 604 and the controller 402 may be elements in a building automation system. Building automation systems are networks of connected computing devices (such as controllers) that can be used to control various elements within the building in which the building automation system is implemented. The building automation system may, for example, control the lights, the heating, ventilation, air conditioning (HVAC) system, and other elements of the building or facility 302. The building automation module 604 may be a software program configured to control the various elements of the building through one or more controllers such as controller 402. The building automation module 604, in the example shown in FIG. 6, can turn light(s) 606 on and off through the controller 402. The building automation module 604 may also be able to dim or otherwise control the light(s) 606 through the controller 402.

The indicator module 200 may receive an identification message 412 that indicates the occurrence of an alarm condition 408 from the control unit 102. The identification message 412 may also indicate that emergency personnel have been dispatched to a facility 302 associated with the indicator module 200. In one embodiment, the control unit 102 does not send the identification message 412 to the indicator module 200 until after emergency personnel have been requested. In such an embodiment, receipt of the identification message 412 is the indication that emergency personnel have been dispatched.

While FIG. 6 illustrates the indicator module 200 receiving the identification message 412 from the control unit 102, the identification message 412, or a portion thereof, may be received from other components in a security system. In one embodiment, the monitoring system 103 (as seen in FIG. 3) may send the identification message 412 to the indicator module 200. The monitoring system 103 may communicate directly with the indicator module 200 over a communications network. In another embodiment, the control unit 102 alerts the indicator module 200 when an alarm condition 408 is detected, and the monitoring system 103 alerts the indicator module 200 when emergency personnel are dispatched to the facility.

The indicator module 200 may cause an identifying alert 406 that identifies the facility, such as facility 302, or a particularly area of the facility associated with the system 600 for which the identification message 412 was generated. The indicator module 200 may do so by sending an instruction 610 to the building automation module 604 that causes the one or more lights 606 to flash. The building automation module 604 may provide an application programming interface (API) or other interface allowing the indicator module 200 to provide the instruction 610. The building automation module 604 may send one or more messages 620 to the controller 402, which may in turn provide control messages 414 that turn the one or more lights 606 on and off.

The indicator module 200, in one embodiment, may send an individual instruction 610 to first turn the one or more lights 606 off, and then another instruction 610 to turn the one or more lights 606 on, and so on, to create a flashing pattern. In such an embodiment, the indicator module 200 may be implemented transparently from the building automation module 604. A transparent implementation may reduce the complexity of the security system and allow implementation over a wide range of building automation systems without requiring changes to the hardware or software of the building automation module 604.

The identification message 412 may identify the location within the facility 302 where the alarm condition 408 was detected. In one embodiment, the indicator module 200 stores a logical map of the locations of sensors 101 for the security system. The indicator module 200 may also store in the logical map one or more lights 606 for the facility, such that the indicator module 200 can determine which light 606 is in the same location, or a proximate location, as a particular sensor 101 using the logical map. The indicator module 200 may determine from the identification message 412 which sensor 101 detected the alarm condition 408, and also determine which light or lights 606 are in the same location as the sensor 101. This may allow the indicator module 200 to restrict the identifying alert 406 to the location of the sensor 101. In such an embodiment, the identifying alert 406 may identify not only the facility for which the alarm condition 408 was generated, but also the location of the sensor 101 that detected the alarm condition 408. In certain situations, such as a fire, this additional information may be useful to emergency personnel.

Figure 7:
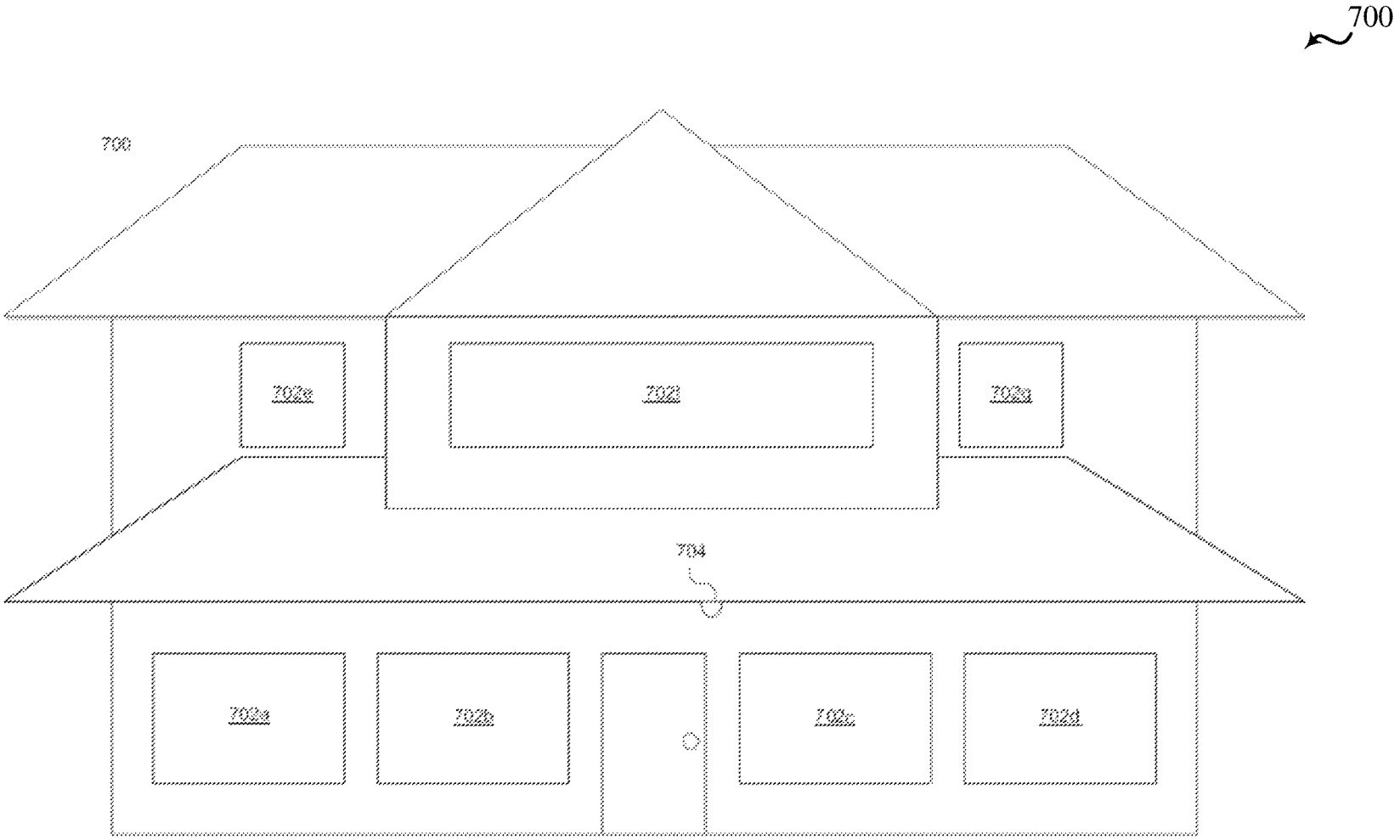
FIG. 7 is an illustration of a home implementing a security system with an identifying alert for emergency personnel.

FIG. 7 illustrates one embodiment of a house 700 protected by a security system providing an indicator 404 as described above. The house 700 includes windows 702*a*-702*g*, and an exterior light 704. The house 700 may include additional exterior lights 704 (not shown). The house 700 may also include a plurality of interior lights 606 (not shown). The house 700 may include a plurality of sensors 101 and a control unit 102, as described above.

In one embodiment, in response to a dispatch notification 512, the control unit 102 may issue one or more identification messages 412 to a controller 402 coupled to the lights 606, 704 of the house 700. The controller 402 may, in one embodiment, alternate the lights in the house 700 to alternate between an on state and an off state in response to the identification messages 412. The flashing lights 606 within the house 700 may be visible through the windows 700*a-g*. In another embodiment, the controller 402 only causes the exterior light or lights 704 to flash and thus provide an identifying alert 406 for emergency personnel. The house 700 may be equipped with a special purpose light 606, such as an exterior strobe light, that may additionally or alternatively provide the identifying alert 406. The house 700 may further have an audible alarm that generates an audible component to the identifying alert 406.

In another embodiment, the controller 402 may combine aspects of the above approaches. For example, the controller 402 may cause the exterior light 704 to flash, and cause the interior light at the location in the house 700 where the alarm condition 408 was detected to flash as well. If, for example, a smoke detector detects smoke in the left-front corner of the house 700, the controller 402 may cause the exterior light 704 to flash, as well as a light in the room containing the smoke detector. The interior flashing light may be visible through the window 702*a*.

Emergency personnel on route are able to detect the identifying alert 406 from the exterior of the house 700. Where the house 700 is on a street with multiple residences on both sides of the street, the identifying alert 406 helps the emergency personnel more quickly determine that the house 700 is the facility they are looking for.

Figure 8:
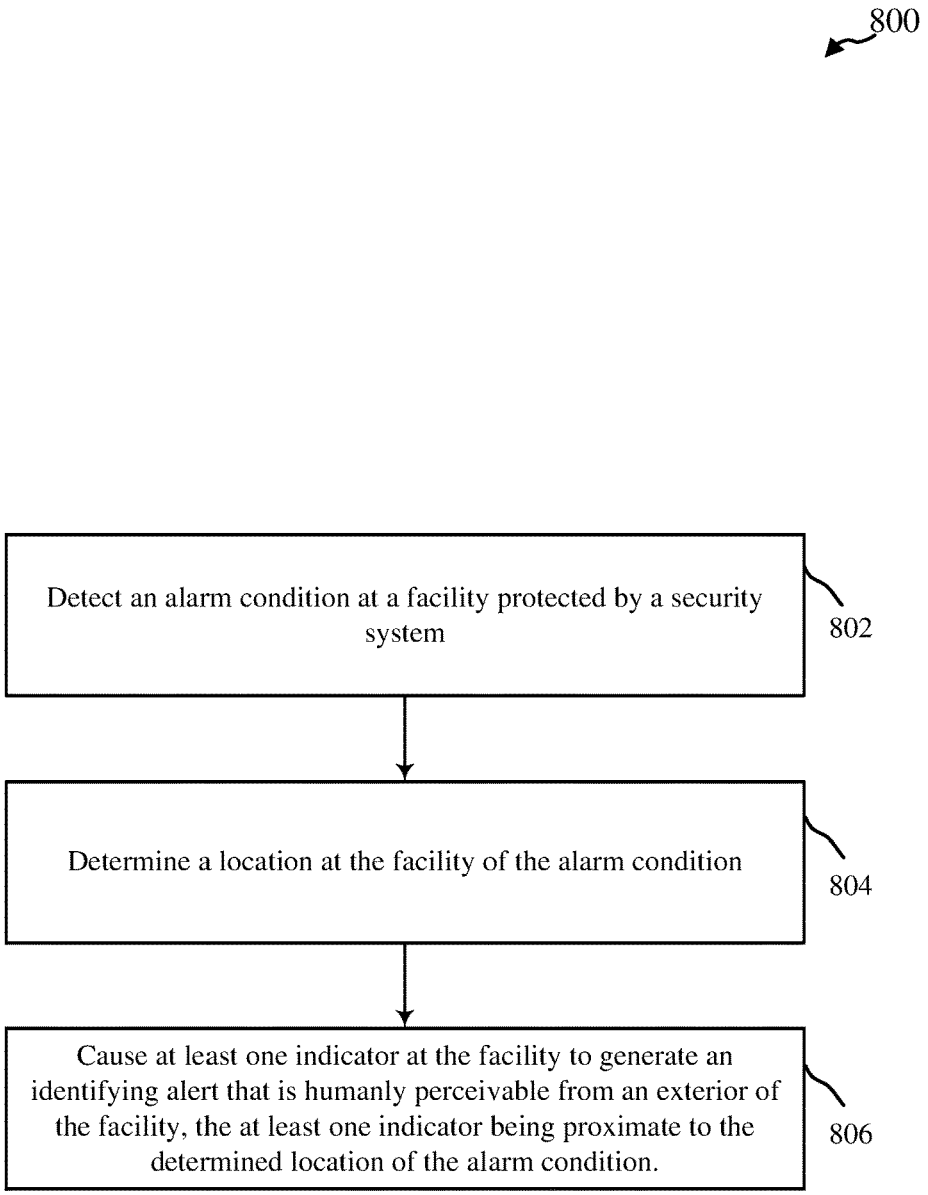
FIGS. 8 and 9 are flow chart diagrams illustrating example embodiments of a method for providing an identifying alert for emergency personnel.

FIG. 8 illustrates one embodiment of a method 800 for providing an identifying alert 406 that identifies a facility 302 at which an alarm condition 408 has occurred. The method 800 begins, in the depicted embodiment, at reference numeral 802 by detecting an alarm condition 408 at a facility 302 protected by a security system, such as system 100. One or more sensors 101 may detect the alarm condition 408 and report the alarm condition to the control unit 102, for example. The method 800 may further involve, at reference numeral 804, determining a location at the facility of the alarm condition, for example, based on the detected alarm condition, a known location of sensors 101 deployed in facility 302, etc.

The method 800 may further involve, at reference numeral 806, causing at least one indicator at the facility to generate an identifying alert that is humanly perceivable from an exterior of the facility, the at least one indicator being proximate to the determined location of the alarm condition. Causing the at least one indicator to generate the identifying alter may include sending an identification message 412 to a controller 402 for an indicator 404 localized to an area of the facility where the alarm condition occurred, via the techniques described above. The identification message 412 may causes the indicator 404 to generate an identifying alert 406 that is humanly perceivable from an exterior of the facility 302 that is protected by the security system associated with the controller 402. As a result, dispatched emergency personnel can more quickly identify the facility 302 and a particular area within the facility 302 based, at least in part, on the identifying alert 406.

In certain embodiments, the method 800 may also include sending a termination message to the controller 402 for the indicator 404 that terminates the identifying alert 406. The user may send a termination message using the control unit 102, either directly or through a remote activation system 131 component such as a cellular phone, a tablet, or other electronic device in communication either directly or indirectly with the controller 402. The termination message may, in certain embodiments, be sent automatically in response to emergency personnel arriving at the facility. For example, a sensor 101 on a door may detect emergency personnel entering the facility and send the termination message in response to their arrival.

Figure 9:
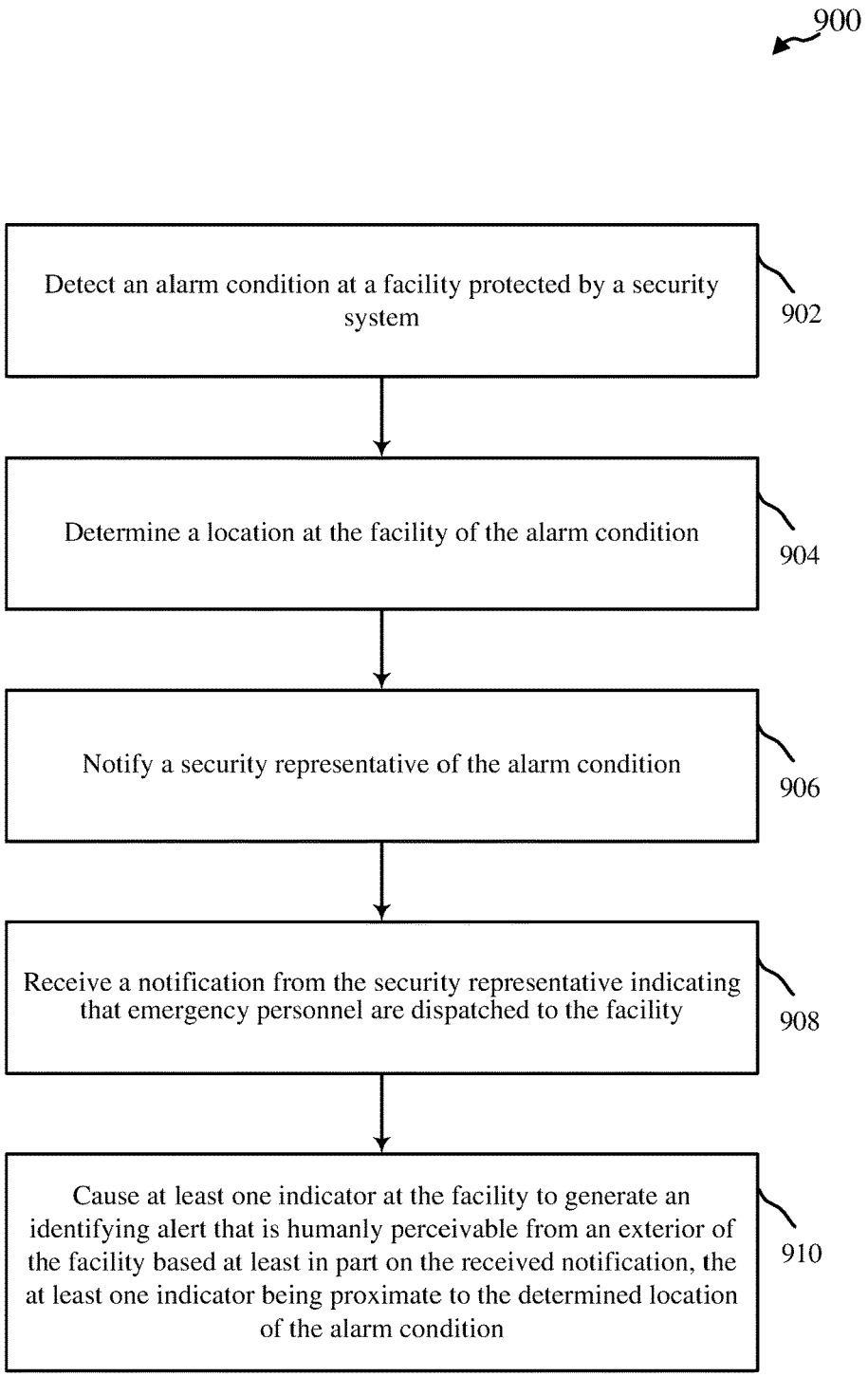

FIG. 9 illustrates one embodiment of a method 900 for providing an identifying alert 406 that identifies a facility 302 at which an alarm condition 408 has occurred. The method 900 may begin, in the depicted embodiment, at reference numeral 902 by detecting an alarm condition 408 at a facility 302 protected by a security system, such as system 100. One or more sensors 101 may detect the alarm condition 408 and report the alarm condition to the control unit 102, for example. The method 900 may further involve, at reference numeral 904, determining a location at the facility of the alarm condition, for example, based on the detected alarm condition, a known location of sensors 101 deployed in facility 302, etc.

The method 900 may involve, at reference numeral 906, notifying a security representative of the alarm condition 408. In one example, the control unit 102 may, after receiving an alarm condition message 410, send an alarm communication 510 to the monitoring system 103 which communicates information about the alarm condition 408 to the security representative. The method 900 may continue at reference numeral 908, by receiving a notification (such as dispatch notification 512) from the security representative indicating that emergency personnel are dispatched to the facility. For example, after calling the emergency response center 306, the security representative may send the notification. In response, the method 900 may include, at reference numeral 910, causing at least one indicator at the facility to generate an identifying alert that is humanly perceivable from an exterior of the facility based at least in part on the received notification, the at least one indicator being proximate to the determined location of the alarm condition. As a result, dispatched emergency personnel can more quickly identify the facility 302 and a particular area within the facility 302 based, at least in part, on the identifying alert 406.

Although the foregoing description contains many specifics, these should not be construed as limiting the scope of the disclosure or of any of the appended claims, but merely as providing information pertinent to some specific embodiments that may fall within the scopes of the disclosure and the appended claims. Features from different embodiments may be employed in combination. In addition, other embodiments of the disclosure may also be devised which lie within the scopes of the disclosure and the appended claims. The scope of the disclosure is, therefore, indicated and limited only by the appended claims and their legal equivalents. All additions, deletions and modifications to the disclosure, as disclosed herein, that fall within the meaning and scopes of the claims are to be embraced by the claims.

What is claimed is:

1. A security and automation system comprising:

a sensor, at a premises, configured to generate alarm condition messages in response to alarm conditions;

a control unit, at the premises, communicatively coupled to the sensor and one or more indicators, the control unit configured to:

receive an alarm condition message from the sensor based on the sensor detecting an alarm condition;

send a dispatch request to emergency personnel upon receiving the alarm condition message;

determine a location of the alarm condition within the premises based at least in part on the alarm condition message;

receive a dispatch notification indicating that the emergency personnel are dispatched to the premises in response to sending the dispatch request;

identify a time of day in relation to receiving the alarm condition message from the sensor;

upon receiving both the alarm condition message and the dispatch notification and determining the time of day indicates a time within predetermined daylight hours, activate both a visual alert and an audible alert in at least one premises location indicator or at least one interior location indicator, or at least one of each; and upon determining the time of day indicates a time within predetermined night time hours, activate the visual alert and bypass activating the audible alert in at least one premises location indicator or the at least one interior location indicator, or at least one of each.

2. The security and automation system of claim 1, the control unit being further configured to:

identify among the one or more interior location indicators a proximate interior location indicator that is nearest to the sensor that detects the alarm condition.

3. The security and automation system of claim 2, the control unit being further configured to:

activate the proximate interior location indicator upon receiving both the alarm condition message and the dispatch notification.

4. The security and automation system of claim 3, the at least one premises location indicator or the at least one interior location indicator, or both, comprising a visual alert, an audible alert, or a combination thereof.

5. The security and automation system of claim 2, the premises location indicator comprising an exterior light of the premises, and the interior location indicator comprising an interior light of the premises.

6. The security and automation system of claim 1, the control unit being further configured to:

validate the alarm condition message, validating the alarm condition comprising confirming both (a) the security and automation system is armed and (b) the alarm condition includes at least one of a door of the premises opening, a window of the premises opening, a motion sensor of the premises being triggered, and a glass break sensor detecting glass breaking at the premises.

7. The security and automation system of claim 6, the control unit being further configured to:

send the dispatch request to emergency personnel upon validating the alarm condition message, the dispatch request including information regarding the premises and the alarm condition.

8. The security and automation system of claim 6, the control unit being further configured to:

bypass sending the dispatch request upon failing to validate the alarm condition message.

9. The security and automation system of claim 6, validating the alarm condition comprising the control unit determining that both (a) the sensor detects smoke at the premises and (b) an occupant of the premises confirms a fire exists at the premises.

10. The security and automation system of claim 1, the sensor comprising at least one of a door sensor, a window sensor, a motion sensor, a glass break sensor, and a smoke sensor.

11. A non-transitory computer-readable storage medium storing instructions that when executed by a processor cause the processor to perform the instructions, the instructions comprising:

receive an alarm condition message from the sensor based on the sensor detecting an alarm condition;

send a dispatch request to emergency personnel upon receiving the alarm condition message;

determine a location of the alarm condition within the premises based at least in part on the alarm condition message;

receive a dispatch notification indicating that the emergency personnel are dispatched to the premises in response to sending the dispatch request;

identify a time of day in relation to receiving the alarm condition message from the sensor;

upon receiving both the alarm condition message and the dispatch notification and determining the time of day indicates a time within predetermined daylight hours, activate both a visual alert and an audible alert in at least one premises location indicator or at least one interior location indicator, or at least one of each; and upon determining the time of day indicates a time within predetermined night time hours, activate the visual alert and bypass activating the audible alert in at least one premises location indicator or the at least one interior location indicator, or at least one of each.

12. The non-transitory computer-readable storage medium of claim 11, the instructions further comprising:

identify among the one or more interior location indicators a proximate interior location indicator that is nearest to the sensor that detects the alarm condition.

13. The non-transitory computer-readable storage medium of claim 12, the instructions further comprising:

activate the proximate interior location indicator upon receiving both the alarm condition message and the dispatch notification.

14. The non-transitory computer-readable storage medium of claim 13, the at least one premises location indicator or the at least one interior location indicator, or both, comprising a visual alert, an audible alert, or a combination thereof.

15. The non-transitory computer-readable storage medium of claim 12, the premises location indicator comprising an exterior light of the premises, and the interior location indicator comprising an interior light of the premises.

16. The non-transitory computer-readable storage medium of claim 15, the instructions further comprising:

validate the alarm condition message, validating the alarm condition comprising confirming both (a) the security and automation system is armed and (b) the alarm condition includes at least one of a door of the premises opening, a window of the premises opening, a motion sensor of the premises being triggered, and a glass break sensor detecting glass breaking at the premises.

17. The non-transitory computer-readable storage medium of claim 16, the instructions further comprising:

send the dispatch request to emergency personnel upon validating the alarm condition message, the dispatch request including information regarding the premises and the alarm condition.

18. The non-transitory computer-readable storage medium of claim 16, the instructions further comprising:

bypass sending the dispatch request upon failing to validate the alarm condition message.

19. The non-transitory computer-readable storage medium of claim 16, the instructions to validate the alarm condition further comprising:

determine that both (a) the sensor detects smoke at the premises and (b) an occupant of the premises confirms a fire exists at the premises.

20. A method comprising:

receiving an alarm condition message from the sensor based on the sensor detecting an alarm condition;

sending a dispatch request to emergency personnel upon receiving the alarm condition message;

determining a location of the alarm condition within the premises based at least in part on the alarm condition message;

receiving a dispatch notification indicating that the emergency personnel are dispatched to the premises in response to sending the dispatch request;

identifying a time of day in relation to receiving the alarm condition message from the sensor;

upon receiving both the alarm condition message and the dispatch notification and determining the time of day indicates a time within predetermined daylight hours, activating both a visual alert and an audible alert in at least one premises location indicator or at least one interior location indicator, or at least one of each; and upon determining the time of day indicates a time within predetermined night time hours, activating the visual alert and bypass activating the audible alert in at least one premises location indicator or the at least one interior location indicator, or at least one of each.

* * * * *